US009469895B2

(12) United States Patent
Suzuki et al.

(10) Patent No.: US 9,469,895 B2
(45) **Date of Patent: *Oct. 18, 2016**

(54) SPRING STEEL AND SURFACE TREATMENT METHOD FOR STEEL MATERIAL

(75) Inventors: Takeshi Suzuki, Yokohama (JP); Yoshiki Ono, Yokohama (JP); Shimpei Kurokawa, Yokohama (JP)

(73) Assignee: NHK SPRING CO., LTD., Kanagawa (JP)

( * ) Notice: Subject to any disclaimer, the term of this patent is extended or adjusted under 35 U.S.C. 154(b) by 1085 days.

This patent is subject to a terminal disclaimer.

(21) Appl. No.: 13/581,962

(22) PCT Filed: Mar. 18, 2011

(86) PCT No.: PCT/JP2011/056570

§ 371 (c)(1),
(2), (4) Date: Aug. 30, 2012

(87) PCT Pub. No.: WO2011/115255

PCT Pub. Date: Sep. 22, 2011

(65) Prior Publication Data

US 2012/0318407 A1 Dec. 20, 2012

(30) Foreign Application Priority Data

Mar. 18, 2010 (JP) ..... 2010-062591

(51) Int. Cl.

| | |
|---|---|
| ***C23C 8/26*** | (2006.01) |
| ***C21D 1/18*** | (2006.01) |
| ***C21D 9/02*** | (2006.01) |
| ***C22C 38/02*** | (2006.01) |
| ***C22C 38/04*** | (2006.01) |
| ***C23C 8/32*** | (2006.01) |
| ***C23C 8/80*** | (2006.01) |
| ***C21D 1/76*** | (2006.01) |
| ***C21D 6/00*** | (2006.01) |
| ***C21D 1/06*** | (2006.01) |
| ***C21D 9/04*** | (2006.01) |

(52) U.S. Cl.

CPC . *C23C 8/26* (2013.01); *C21D 1/06* (2013.01); *C21D 1/18* (2013.01); *C21D 1/76* (2013.01); *C21D 6/005* (2013.01); *C21D 6/008* (2013.01); *C21D 9/02* (2013.01); *C21D 9/04* (2013.01); *C22C 38/02* (2013.01); *C22C 38/04* (2013.01); *C23C 8/32* (2013.01); *C23C 8/80* (2013.01)

(58) Field of Classification Search

CPC ..... C23C 8/26; C23C 8/32; C23C 8/80; C21D 1/06; C21D 1/18; C21D 1/76; C21D 6/005; C21D 6/008; C21D 9/02; C21D 9/04; C22C 38/02; C22C 38/04

See application file for complete search history.

(56) References Cited

U.S. PATENT DOCUMENTS

| | | | |
|---|---|---|---|
| 4,366,008 | A | 12/1982 | Takeuchi et al. |
| 2009/0020195 | A1 | 1/2009 | Kubota et al. |
| 2011/0310924 | A1 | 12/2011 | Kubota et al. |

FOREIGN PATENT DOCUMENTS

| | | | |
|---|---|---|---|
| CN | 85100662 | A | 7/1986 |
| EP | 2 058 414 | A1 | 5/2009 |
| FR | 2142158 | | 1/1973 |
| GB | 1 402 144 | | 8/1975 |
| JP | A-56-84416 | | 7/1981 |
| JP | A-3-219040 | | 9/1991 |
| JP | A-6-158226 | | 6/1994 |
| JP | A-7-179985 | | 7/1995 |
| JP | A-8-134545 | | 5/1996 |
| JP | A-8-170152 | | 7/1996 |
| JP | A-2005-139508 | | 6/2005 |
| JP | A-2007-46088 | | 2/2007 |
| JP | A-2009-013436 | | 1/2009 |
| JP | B2-4229609 | | 2/2009 |
| JP | A-2009-84683 | | 4/2009 |
| JP | A-2009-191294 | | 8/2009 |

OTHER PUBLICATIONS

Jun. 21, 2011 International Search Report issued in International Application No. PCT/JP2011/056570 (with translation).
Extended European Search Report issued in European Patent Application EP 11756438.5 dated Aug. 29, 2014.

*Primary Examiner* — Roy King
*Assistant Examiner* — Caitlin Kiechle
(74) *Attorney, Agent, or Firm* — Oliff PLC

(57) ABSTRACT

A surface treatment method for a steel material includes carbonitriding, quenching, and tempering. The steel material consists of, by weight %, 0.27 to 0.48% of C, 0.01 to 2.2% of Si, 0.30 to 1.0% of Mn, not more than 0.035% of P, not more than 0.035% of S, and the balance of Fe and inevitable impurities. The carbonitriding step is performed by heating the steel at a temperature of not less than the $A_3$ point and not more than 1100° C. and bringing the steel into contact with a mixed gas atmosphere so as to concentrate nitrogen and carbon at a surface layer of the steel. The quenching step is performed by cooling the steel to room temperature at a rate of not less than 20° C./second. The tempering step is performed by heating the steel at a temperature of 100 to 400° C.

9 Claims, No Drawings

SPRING STEEL AND SURFACE TREATMENT METHOD FOR STEEL MATERIAL

TECHNICAL FIELD

The present invention relates to a spring steel and to a surface treatment method for a steel material. In particular, the present invention relates to a technique for forming a thick high hardness layer by a carbonitriding treatment while minimizing generation of nitrogen compounds on a surface layer of a steel material.

BACKGROUND ART

In recent years, for example, in automobile valve springs, there is a trend of reducing dimensions and weight because it is desired to decrease friction loss of valve systems and obtain a crumple space in an engine compartment. Therefore, the strength required for a spring steel material has been increasing. In general, fatigue strength of a steel increases with hardness until the material hardness is not more than approximately 400 HV. The increasing rate of the fatigue strength slows in a high hardness range in which the hardness is greater than approximately 400 HV. Then, when the hardness is further increased, the increasing rate of the fatigue strength tends to be saturated. One reason for this is increase of notch sensitivity of the steel with the increase of the hardness. Since the hardnesses of spring steels and springs in recent years exceed 500 HV, it is expected that the fatigue strength cannot be greatly increased by increasing the hardness of the entirety of a steel material. In view of this, the following methods are disclosed in order to solve such a problem.

A spring with superior fatigue characteristics is disclosed in Japanese Unexamined Patent Application Laid-open No. 8-170152. In this case, crystal grains are refined by adding V, Nb, or the like, whereby toughness of a steel material is improved. Naturally, in this spring, while the fatigue characteristics are improved, the cost of the steel material is high because the above elements are expensive.

A technique for providing high fatigue strength is disclosed in Japanese Unexamined Patent Application Laid-open No. 8-134545. In this technique, a quenching and tempering treatment is performed by using a high-frequency induction heating. As a result, structure of a steel material is refined, and fine carbides are dispersed and precipitated so as not to precipitate at grain boundaries, whereby toughness of the steel material is improved. Since springs generally have three-dimensional shapes, it is not easy to control temperature of each portion of a steel material by using the high-frequency induction heating. Accordingly, control of the heating conditions is complicated, which results in high production cost.

A spring steel with superior fatigue characteristics is disclosed in Japanese Unexamined Patent Application Laid-open No. 6458226. The spring steel contains oxide inclusions that consist of, by weight %, 30 to 60% of $SiO_2$, 10 to 30% of $Al_2O_3$, 10 to 30% of CaO, and 3 to 15% of MgO, and that have grain sizes of not more than 15 μm in circle-equivalent diameter. However, it is difficult to control the compositions and the grain sizes of the oxide inclusions to be in the above range. In this regard, it is necessary to inspect whether the amounts of the oxide inclusions in produced spring steels are in the above range. In spring steels other than spring steels which are inspected, even if they have the same lot, the amounts of the oxide inclusions may be out of the above range. In this case, a spring made of the spring steel has a potential of break at an early time due to the oxide inclusions.

A carbonitrided hardened material and a production method therefor are disclosed in Japanese Unexamined Patent Application Laid-open No. 2007-46088. The carbonitrided hardened material does not have brittle nitrogen compounds at a surface layer, but has a nitrogen diffused layer from the surface to a predetermined depth where nitrogen is solid solved. In addition, the carbonitrided hardened material is subjected to a quenching treatment. According to this technique, the nitrogen compounds that can become starting points of breaks are not formed after a carbonitriding treatment, and the surface layer has high hardness, whereby the fatigue strength may be improved. However, in an example disclosed in Japanese Unexamined Patent Application Laid-open No. 2007-46088, a high hardness layer at the surface layer had a thickness of approximately 0.06 mm at most and was too thin to greatly improve the fatigue strength. In this case, the carbonitriding treatment is performed at a temperature of 600 to 800° C. In this temperature range, the center portion of a steel of the present invention is difficult to be austenitized and is incompletely hardened even by a subsequent rapid cooling. Therefore, the steel cannot have a center portion with hardness of not less than 500 HV, which is necessary when used as a spring.

A carburized gear part is disclosed in Japanese Patent No. 4229609. The carburized gear part is made by carburizing under reduced-pressure atmosphere of 1 to 30 hPa and thereby has a carburized layer with surface hardness of 700 to 900 HV. The reduced-pressure carburizing is different from gas carburizing which is conventionally widely used. In the reduced-pressure carburizing, grain-boundary oxidation that can generate starting points of breaks is prevented, and a thick high hardness layer is obtained by means of high treatment temperature (950° C. or higher). In this case, since the reduced-pressure carburizing is performed by non-equilibrium decomposition reaction of acetylene, the absorbed amount of carbon cannot be controlled as well as the gas carburizing. Therefore, the absorbed amount of carbon varies depending on portions and a shape of a member that was subjected to the reduced-pressure carburizing, whereby a high hardness layer is difficult to obtain uniformly. Accordingly, a treatment method, in which the absorbed amount of carbon or the like is easily controlled, is required.

DISCLOSURE OF THE INVENTION

Accordingly, the present invention has been completed in view of these circumstances, and an object of the present invention is to provide a spring steel and a surface treatment method for a steel material. According to the surface treatment method, addition of expensive elements and complicated temperature control are not necessary, whereby a spring steel is produced at a low cost. In the surface treatment method, a nitrogen compound layer and a carbon compound layer are formed at a surface layer of a spring steel so as to have minimum thicknesses. Moreover, a predetermined degree of hardness at a center portion of a spring steel, and a predetermined thickness of a high hardness layer, are obtained.

The inventors of the present invention conducted intensive research on a method for forming a thick surface high hardness layer without decreasing toughness at a center portion and without generating great amounts of brittle nitrogen compounds and carbon compounds in a spring steel and a spring. As a result, the inventors of the present invention found that a steel material is obtained by performing a chemical surface treatment on an ordinary carbon steel with no special elements at a predetermined temperature and then by quenching and tempering. The steel material is formed with a thick surface high hardness layer and with few brittle nitrogen compounds and carbon compounds at a surface layer. In addition, the steel material has a center portion with a predetermined hardness for having a sufficient toughness.

The present invention provides a surface treatment method for a steel material, and the method has been completed based on the above finding. The steel material consists of, by weight %, 0.27 to 0.48% of C, 0.01 to 2.2% of Si, 0.30 to 1.0% of Mn, not more than 0.035% of P, not more than 0.035% of S, and the balance of Fe and inevitable impurities. The method includes a step of carbonitriding the steel by heating at a temperature of not less than the $A_3$ point of the steel and not more than 1100° C. and bringing the steel into contact with a mixed gas atmosphere so as to concentrate nitrogen and carbon at a surface layer of the steel. The mixed gas atmosphere consists of not less than 50 vol % of $NH_3$ and the balance of inert gas and inevitable impurities. The method also includes a step of quenching the steel to room temperature at a rate of not less than 20° C./second and a step of tempering the steel at a temperature of 100 to 400° C.

The present invention also provides a spring steel and a spring, which can be obtained by the above method. The spring steel and the spring consist of, by weight %, 0.27 to 0.48% of C, 0.01 to 2.2% of Si, 0.30 to 1.0% of Mn, not more than 0.035% of P, not more than 0.035% of S, and the balance of Fe and inevitable impurities. Each of the spring steel and the spring has a nitrogen compound layer and a carbon compound layer at a total thickness of not more than 2 μm at the surface thereof and has a center portion with hardness of 500 to 700 HV in a cross section. Each of the spring steel and the spring also has a high hardness layer under the nitrogen compound layer and the carbon compound layer. The high hardness layer has a thickness of 0.1 to 1.0 mm and has greater hardness than that of the center portion by 100 to 500 HV. The cross section preferably has a circle-equivalent diameter of 1.5 to 15.0 mm. The "cross section" is a cross section that orthogonally crosses a longitudinal direction of the spring steel or the spring.

The grounds of limiting the above numerical values and the functions of the present invention will be described hereinafter. First, the reason for limiting the chemical composition of the steel used in the present invention will be described. It should be noted that the symbol "%" represents "weight %" in the following descriptions. C, 0.27 to 0.48%

C is necessary for obtaining strength of the steel, which is sufficient for bear a load and is necessary for a spring, by the quenching and the tempering. In general, the hardness of a steel material tends to be increased with the increase of the concentration of C. Therefore, in order to obtain a center portion with not less than 500 HV in the steel material after the tempering even at 400° C. in the surface treatment method of the present invention, the concentration of C must be not less than 0.27%. On the other hand, if the concentration of C is excessive, the hardness of the center portion exceeds 700 HV after the quenching, and the toughness is greatly decreased. In this case, the hardness of the center portion can be decreased by tempering at high temperature of greater than 400° C. However, at the same time, nitrogen compounds and carbon compounds are generated in a nitrogen solid-solved layer and a carbon solid-solved layer. Accordingly, in order to obtain a center portion with hardness of not more than 700 HV in the steel material by performing a tempering even at a low temperature so as to not generate the nitrogen compounds and the carbon compounds, the concentration of C is set to be not more than 0.48%.

Si: 0.01 to 2.2%

Si is a deoxidizing element that is effective in steel refining, and it is necessary to add Si at not less than 0.01%. In addition, Si is a solid-solution strengthening element and is effective for obtaining high strength. If the concentration of Si is excessive, workability is decreased. Therefore, the concentration of Si is set to be not more than 2.2%.

Mn: 0.30 to 1.0%

Mn is added as a deoxidizing element. Mn has a solid-solution strengthening effect and improves quenchability, and therefore, Mn is added at not less than 0.30%. On the other hand, if the concentration of Mn is excessive, segregation occurs, and the workability tends to be decreased. Therefore, the concentration of Mn is set to be not more than 1.0%.

P: not more than 0.035%, S: not more than 0.035%

P and S facilitate grain-boundary fracture by grain-boundary segregation. Therefore, the concentrations of P and S are desirably lower, and the upper limits thereof are set to be 0.035%. The concentrations of P and S are preferably not more than 0.01%.

Next, steps for obtaining a high hardness layer will be described. The high hardness layer of the present invention is generated by performing a carbonitriding step, a quenching step, and a tempering step, in this order. The carbonitriding step is performed by heating a steel at a temperature of not less than the $A_3$ point of the steel and not more than 1100° C. and bringing the steel into contact with a mixed gas atmosphere so as to concentrate nitrogen and carbon at a surface layer of the steel. The mixed gas atmosphere consists of not less than 50 vol % of $NH_3$ and the balance of inert gas and inevitable impurities. The quenching step is performed by cooling the steel to mom temperature at a rate of not less than 20° C./second. The tempering step is performed by heating the steel at a temperature of 100 to 400° C. The structure of the steel material before the heating at not less than the $A_3$ point is not specially limited. For example, a hot forged bar steel material or a drawn wire steel material may be used as a raw material. The reasons for the limitations in each step will be described hereinafter.

Carbonitriding Step

In order to austenitize the center portion of the steel material, the steel material must be heated to be not less than the $A_3$ point. On the other hand, if the heating temperature is too high, $NH_3$ gas is decomposed immediately after it is introduced, and absorption of nitrogen and carbon into a member to be carbonitrided is greatly decreased. Therefore, the upper limit of the heating temperature is set to be 1100° C. The heating temperature is desirably 850 to 1000° C. The function of absorption of the carbon will be described later.

Moreover, in order to concentrate nitrogen and carbon at the surface layer, the steel material must be brought into contact with a mixed gas atmosphere consisting of not less than 50 vol % of $NH_3$ and the balance of inert gas and inevitable impurities. If the concentration of $NH_3$ is less than 50 vol % in the mixed gas atmosphere, the absorbed amounts of nitrogen and carbon per unit time are small. Therefore, a long time is required so as to obtain a high hardness layer of a predetermined thickness, which becomes a problem in a practical production. If the concentration of $HN_3$ is greater than 90 vol %, nitrogen compounds and carbon compounds tend to be generated. Accordingly, the concentration of $NH_3$ is preferably 80 to 90 vol %.

The heating time in the carbonitriding step is desirably 15 to 110 minutes. If the heating time is less than 15 minutes, there is a case in which a high hardness layer of a predetermined thickness is not obtained. On the other hand, if the heating time is greater than 110 minutes, the nitrogen compounds and the carbon compounds with a total thickness of more than 2 μm are easily formed at the surface layer, which may become starting points of cracks. In addition, when the nitrogen compounds and the carbon compounds with a total thickness of more than 2 μm are formed, they are very difficult to remove completely, even by shot peening.

As described above, in the carbonitriding step, the heating temperature, the composition of the mixed gas, and the heating time are important parameters for forming a thick high hardness layer. These parameters are also important for decreasing generation of the nitrogen compounds and the carbon compounds at the surface layer by diffusing nitrogen and carbon, which are absorbed at the surface of the steel, to the inside.

The function of concentrating carbon at the surface layer of the steel material by bringing the steel material into contact with the mixed gas of $NH_3$ and the inert gas will be described hereinafter. The inventors of the present invention investigated distribution conditions of carbon inside a steel material and found that the amount of carbon inside the steel material was not changed before and after the carbonitriding step. Therefore, it is expected that the carbon concentrated at the surface layer was not the carbon which moved from the inside of the steel material. Although the reason for the concentrating of carbon at the surface layer is not clear, it may be supposed to be as follows. That is, $NH_3$ on the surface of the steel material is decomposed into atoms of nitrogen and hydrogen by Fe as a catalyst under the above conditions. The atom of nitrogen is expected to be in a radical condition having unpaired electrons. The radical nitrogen keeps the radical condition for some reason even when it is absorbed and is solid solved in the steel. Therefore, in an analysis using an Electron Probe Microanalyzer (EPMA-1600 manufactured by Shimadzu Corporation), there is a possibility that the wavelength of characteristic X-rays of nitrogen is changed and the radical nitrogen is detected as carbon. The Electron Probe Microanalyzer was used in an element analysis described in the Best Mode for Carrying Out the Invention.

Quenching Step

In the quenching step after the carbonitriding step, the cooling to room temperature is preferably faster. The quenching step must be performed at a cooling rate of not less than 20° C./second. If the cooling rate is less than 20° C./second, pearlite is generated during the cooling, and the quenching is not completely performed, whereby a predetermined hardness is not obtained. The cooling to room temperature is preferably performed at not less than 50° C./second.

Tempering Step

After the quenching step, the center portion of the steel material has a martensite structure. This martensite structure includes strain, which is generated by the quenching, and thereby causes failure such as delayed cracks. Moreover, this martensite structure has extremely low toughness and cannot provide a necessary withstand load when used as a spring. Therefore, tempering is performed. The tempering must be performed at not less than 100° C. so as to decrease the strain at the center portion of the steel material. On the other hand, if the tempering temperature exceeds 400° C., the hardness of the center portion of the steel material is decreased, whereby the steel material cannot bear a load when used as a spring. In addition, the solid-solved nitrogen and carbon undesirably form compounds.

Then, the reason for limiting physical characteristics of the spring steel and the spring of the present invention will be described hereinafter.

Thickness of Nitrogen Compound Layer and Carbon Compound Layer at Surface

The nitrogen compounds and the carbon compounds are brittle and have low toughness, and thereby facilitate generation of cracks if they are formed on the surface of the steel. Therefore, although some amounts of the nitrogen compounds and the carbon compounds are allowable, the upper limit of the total thickness thereof is 2 μm, and preferably, not more than 1 μm.

Hardness of Center Portion of Steel Material

The hardness of the center portion of the steel material is required to be not less than 500 HV in order to obtain strength which is sufficient for bearing a load and which is necessary for a spring. On the other hand, if the hardness is too high, notch sensitivity of the steel material is increased, whereby the fatigue strength is decreased. Therefore, the hardness of the center portion of the steel material is set to be not more than 700 HV.

Difference of Hardness between High Hardness Layer and Center Portion

The high hardness layer at the surface layer is very effective for preventing generation of cracks and is required to have greater hardness than that of the center portion by not less than 100 HV. On the other hand, if the high hardness layer has an excessive degree of hardness, it is very brittle. Therefore, the upper limit of the difference of hardness between the high hardness layer and the center portion is 500 HV.

Thickness of High Hardness Layer

The high hardness layer is required to have a thickness of not less than 0.1 mm so as to prevent generation of cracks, and it desirably has a thickness of not less than 0.3 mm. On the other hand, if the high hardness layer is too thick, the toughness of the steel material is decreased. Therefore, the thickness of the high hardness layer is limited to be not more than 1.0 mm.

Total Concentration of Nitrogen and Carbon in Carbonitrided Layer

In the present invention, the nitrogen compound layer and the carbon compound layer desirably have a carbonitrided layer thereunder. The carbonitrided layer includes nitrogen and carbon at a total average concentration that is greater than that in the entire composition by 0.1 to 1.5 weight %. The carbonitrided layer desirably has a thickness of not less than 0.1 mm, and more desirably has a thickness of 0.1 to 0.5 mm. It is not necessary that the carbonitrided layer correspond to the high hardness layer. By setting the total concentration of nitrogen and carbon in the carbonitrided layer to be greater than the total average concentration of nitrogen and carbon in the steel material by not less than 0.1%, hardness is increased by solid-solution strengthening of nitrogen and carbon. One of the features of the present invention is that nitrogen and carbon are solid solved in the surface layer. In this case, since nitrogen has a higher maximum solid-solution concentration than that of carbon, it is efficient to solid solve nitrogen at a greater amount for obtaining a thick high hardness layer. On the other hand, increases of concentrations of nitrogen and carbon lower starting temperature ($M_8$ point) of martensitic transformation. As a result, an excessive amount of residual austenite is generated after the quenching, and the hardness is decreased. Therefore, the total concentration of nitrogen and carbon in the surface layer is desirably greater than that in the entire composition of the steel material by not more than 1.5%. If the carbonitrided layer has a thickness of less than 0.1 mm, the above effects are not sufficiently obtained. If the carbonitrided layer has a thickness of greater than 0.5 mm, the toughness of the steel material tends to be decreased. Therefore, the thickness of the carbonitrided layer is desirably not more than 0.5 mm.

Effects of the Invention

According to the present invention, addition of expensive elements and complicated temperature control are not necessary, whereby a spring steel is produced at low cost. Moreover, a nitrogen compound layer and a carbon compound layer are formed at a surface layer of a spring steel so as to have minimum thicknesses. Furthermore, a predetermined degree of hardness at a center portion of a spring steel, and a predetermined thickness of a high hardness layer are obtained.

BEST MODE FOR CARRYING OUT THE INVENTION

Round bar steel materials A and B that had an average chemical composition shown in Table 1 and that had a diameter of 4 mm were prepared. The round bar steel materials were subjected to a carbonitriding treatment under conditions shown in Table 2. Then, the round bar steel materials were quenched by cooling to room temperature at a rate of not less than 20° C./second and were tempered for 60 minutes. In the steel materials thus obtained, various characteristics were investigated in the following manner.

TABLE 1

| | Typical chemical composition (mass %) The balance is iron and inevitable impurities | | | | | | |
|---|---|---|---|---|---|---|---|
| Steel type | C | Si | Mn | Cr | P | S | $A_3$ (° C.) |
| A | 0.32 | 0.27 | 0.76 | — | 0.01 | 0.01 | 802 |
| B | 0.63 | 1.45 | 0.65 | 0.65 | 0.01 | 0.01 | 796 |

Note:
The underline indicates that the value does not satisfy the condition described in the present invention.

Total Thickness of Nitrogen Compounds and Carbon Compounds at Surface

An X-ray diffraction profile was measured with respect to an outer circumferential side surface of the round bar steel. Then, generation of nitrogen compounds and carbon compounds at the surface of the steel material was determined from existence of peaks corresponding to them. The total thickness of the nitrogen compounds and the carbon compounds was measured from element distributions of nitrogen and carbon, which were obtained by using EPMA.

Hardness of Center Portion

Hardness was measured at a center portion of the steel material in a cross section.

Thickness of High Hardness Layer

Hardness was measured from the outer circumferential surface to the center of the steel material in the cross section. Then, a high hardness layer having hardness greater than that of the center portion by 100 to 500 HV was identified, and the thickness thereof from the surface was measured.

Average Hardness of High Hardness Layer

In the high hardness layer, hardness was measured at 0.025 mm intervals from the outer circumferential surface to the center of the steel material, and an average value thereof was calculated.

Thickness of Area in which Total Concentration of Nitrogen and Carbon was Increased in Surface Layer (Thickness of Carbonitrided Layer)

In the cross section of the steel material, an element distribution (quantitative value) of each of nitrogen and carbon was measured by using EPMA. Next, thickness of an area (carbonitrided layer) was measured. In the area, the total amount of nitrogen and carbon was greater than that in the entire composition (total concentration at the center portion of the steel material) by 0.1 to 1.5%.

The above-measured results are shown in Table 2. Each sample of the samples Nos. 4 to 14 that satisfied the conditions of the present invention had a thick high hardness layer. In contrast, in the comparative sample of the samples Nos. 1 to 3, the temperature in the carbonitriding treatment was lower than the $A_3$ point, and the austenitizing was insufficiently performed, whereby the hardening was insufficient. Therefore, the hardnesses of the center portions were low, and the steel materials of the samples Nos. 1 to 3 cannot provide a sufficient withstand load that is necessary for a spring. In the sample of the sample No. 3, since the carbonitriding treatment was performed for too long a time, nitrogen compounds and carbon compounds were generated at a total thickness of 10 μm on the surface, which facilitated generation of cracks.

TABLE 2

| | | Carbonitriding treatment | | | | | | |
|---|---|---|---|---|---|---|---|---|
| No. | Steel type | Time (minutes) | Temperature (° C.) | Concentration of $NH_3$ in atmosphere gas (vol %) | Tempering temperature (° C.) | Thickness of nitrogen compounds and carbon compounds on surface (μm) | Hardness of center portion (HV) | Thickness of high hardness layer having greater hardness than that of center portion by 100 to 500 HV (mm) |
| 1 | A | 20 | 800 | 88 | 200 | 0 | 456 | 0.15 |
| 2 | A | 83 | 800 | 88 | 200 | 0 | 455 | 0.25 |
| 3 | A | 120 | 800 | 88 | 200 | 10 | 460 | 0.25 |
| 4 | A | 20 | 830 | 88 | 200 | 0 | 533 | 0.24 |
| 5 | A | 20 | 860 | 88 | 200 | 0 | 588 | 0.18 |
| 6 | A | 20 | 890 | 88 | 200 | 0 | 583 | 0.19 |

TABLE 2-continued

| | | | | | | | | |
|---|---|---|---|---|---|---|---|---|
| 7 | A | 20 | 920 | 88 | 200 | 0 | 578 | 0.26 |
| 8 | A | 20 | 950 | 88 | 200 | 0 | 582 | 0.13 |
| 9 | A | 83 | 830 | 88 | 200 | 0 | 572 | 0.33 |
| 10 | A | 83 | 860 | 88 | 200 | 0 | 548 | 0.38 |
| 11 | A | 83 | 890 | 88 | 200 | 0 | 571 | 0.47 |
| 12 | A | 83 | 920 | 88 | 200 | 0 | 577 | 0.48 |
| 13 | A | 83 | 950 | 88 | 200 | 0 | 560 | 0.44 |
| 14 | A | 83 | 1100 | 88 | 200 | 0 | 566 | 0.28 |
| 15 | A | 83 | 1200 | 88 | 200 | 0 | 553 | 0.08 |
| 16 | B | 90 | 850 | 91 | Not performed | 0 | 815 | 0 |
| 17 | B | 210 | 800 | 93 | Not performed | 20 | 811 | 0 |
| 18 | B | 105 | 800 | 93 | Not performed | 10 | 786 | 0 |
| 19 | B | 105 | 800 | 88 | Not performed | 8 | 862 | 0 |
| 20 | B | 105 | 800 | 78 | Not performed | 0 | 797 | 0.30 |
| 21 | B | 105 | 800 | 57 | Not performed | 0 | 807 | 0 |
| 22 | B | 105 | 800 | 93 | 400 | 10 | 646 | 0 |
| 23 | B | 105 | 800 | 88 | 400 | 8 | 588 | 0.05 |
| 24 | B | 105 | 800 | 78 | 400 | 0 | 628 | 0 |
| 25 | B | 105 | 800 | 57 | 400 | 0 | 637 | 0 |

| No. | Average hardness of high hardness layer (HV) | Thickness of surface layer including nitrogen and carbon at a total concentration that is greater than that of center portion by 0.1 to 1.5% (mm) | Thickness of surface layer including nitrogen at a concentration greater than that of center portion by 0.1 to 1.5% (mm) | Thickness of surface layer including carbon at a concentration greater than that of cener portion by 0.1 to 1.5% (mm) | Notes |
|---|---|---|---|---|---|
| 1 | 714 | 0.22 | 0.20 | 0.22 | Comparative example |
| 2 | 731 | 0.32 | 0.26 | 0.32 | Comparative example |
| 3 | 772 | 0.34 | 0.28 | 0.34 | Comparative example |
| 4 | 792 | 0.30 | 0.20 | 0.30 | Practical example |
| 5 | 860 | 0.28 | 0.24 | 0.28 | Practical example |
| 6 | 843 | 0.22 | 0.22 | 0.22 | Practical example |
| 7 | 779 | 0.22 | 0.22 | 0.22 | Practical example |
| 8 | 713 | 0.10 | 0.10 | 0.10 | Practical example |
| 9 | 772 | 0.42 | 0.23 | 0.42 | Practical example |
| 10 | 845 | 0.55 | 0.32 | 0.55 | Practical example |
| 11 | 832 | 0.64 | 0.44 | 0.64 | Practical example |
| 12 | 796 | 0.60 | 0.54 | 0.60 | Practical example |
| 13 | 754 | 0.52 | 0.34 | 0.52 | Practical example |
| 14 | 687 | 0.15 | 0.10 | 0.15 | Practical example |
| 15 | 660 | 0 | 0 | 0 | Comparative example |
| 16 | — | 0 | 0 | 0 | Comparative example |
| 17 | — | 0.35 | 0.3 | 0.35 | Comparative example |
| 18 | — | 0.63 | 0.33 | 0.63 | Comparative example |
| 19 | — | 0.62 | 0.36 | 0.62 | Comparative example |
| 20 | 956 | 0.48 | 0.22 | 0.48 | Comparative example |

TABLE 2-continued

| | | | | | |
|---|---|---|---|---|---|
| 21 | — | 0.06 | 0.06 | 0.06 | Comparative example |
| 22 | — | 0.63 | 0.33 | 0.63 | Comparative example |
| 23 | 720 | 0.62 | 0.36 | 0.62 | Comparative example |
| 24 | — | 0.48 | 0.22 | 0.48 | Comparative example |
| 25 | — | 0.06 | 0.06 | 0.06 | Comparative example |

Note:
The underline indicates that the value does not satisfy the condition described in the present invention.

In the comparative example of the sample No. 15, the carbonitriding treatment was performed at a temperature that exceeded 1.100° C. Therefore, nitrogen and carbon were scarcely absorbed in the surface layer, and the high hardness layer did not have a necessary thickness (0.1 to 1.0 mm). In addition, a carbonitrided layer was not obtained.

In the comparative example of the sample No. 16, the concentration of carbon in the steel material was greater than the range described in the present invention, and the tempering was not performed. Therefore, the hardness of the center portion was too high, and the toughness of the steel material was inferior. Moreover, in the sample of the sample No. 16, a high hardness layer and a carbonitrided layer were not obtained. Although the reason therefor is not clear, absorption of nitrogen was prevented due to the relative high carbonitriding temperature and the elements and the concentrations thereof contained in the steel, whereby nitrogen and carbon were scarcely absorbed in the surface layer.

In the comparative examples of the samples Nos. 17 to 19, the concentration of carbon in the steel material was greater than the range described in the present invention, and the tempering was not performed. Therefore, the hardnesses of the center portions were too high, and the toughnesses of the steel materials were inferior. In addition, since the carbonitriding was performed for more than 100 minutes, nitrogen compounds and carbon compounds were formed at a total thickness of not less than 8 μm on the surface, which facilitated generation of cracks.

In the comparative example of the sample No. 20, the concentration of $NH_3$ in the atmosphere gas was relatively low, and the absorbed amounts of nitrogen and carbon were small, whereby nitrogen compounds and carbon compounds were not formed on the surface. In this case, a high hardness layer with a thickness of 0.3 mm and a carbonitrided layer with a predetermined thickness were obtained. However, the concentration of carbon in the steel material was greater than the range described in the present invention, and the tempering was not performed. As a result, the hardness of the center portion was too high, and the toughness of the steel material was inferior.

In the comparative example of the sample No. 21, the concentration of $NH_3$ in the atmosphere gas was relatively low, and the absorbed amounts of nitrogen and carbon were small, whereby nitrogen compounds and carbon compounds were not formed on the surface. In this case, the concentration of carbon in the steel material was greater than the range described in the present invention, and the tempering was not performed. Therefore, the hardness of the center portion was too high, and the toughness of the steel material was inferior. Moreover, since the absorbed amounts of nitrogen and carbon were small, a high hardness layer and a carbonitrided layer with a predetermined thickness were not obtained.

In the comparative examples of the samples Nos. 22 to 25, the concentration of carbon in the steel material was greater than the range described in the present invention. Nevertheless, the hardnesses of the center portions were 500 to 700 HV and were in the range described in the present invention because the tempering was performed. In the samples of the samples Nos. 22 and 23, since the carbonitriding was performed for more than 100 minutes, nitrogen compounds and carbon compounds were formed at a total thickness of not less than 8 μm on the surface. Moreover, in the samples of the samples Nos. 22 and 23, since the concentration of $NH_3$ in the atmosphere gas was relatively high, nitrogen and carbon were absorbed into the inside deeply, and a carbonitrided layer with a predetermined thickness was formed. Meanwhile, according to the increases of the concentrations of nitrogen and carbon, the starting temperature ($M_s$ point) of martensitic transformation was lowered. As a result, a soft residual austenite was formed on the surface, and a high hardness layer was not formed or a high hardness layer with an insufficient thickness was formed.

In the samples of the samples Nos. 24 and 25, the concentration of $NH_3$ in the atmosphere gas was relatively low, and the absorbed amounts of nitrogen and carbon were small. Therefore, nitrogen compounds and carbon compounds were not formed on the surface, and a high hardness layer was also not formed. In the sample of the sample No. 25, a carbonitrided layer with a predetermined thickness was not formed for the same reason as described above.

INDUSTRIAL APPLICABILITY

The present invention can be widely applied for valve springs and suspension springs for automobiles and springs for uses other than in automobiles.

The invention claimed is:

1. A surface treatment method for a steel material consisting of, by weight %, 0.27 to 0.48% of C, 0.01 to 2.2% of Si, 0.30 to 1.0% of Mn, not more than 0.035% of P, not more than 0.035% of S, and the balance of Fe and inevitable impurities, the method comprising, in this order:

a step of carbonitriding the steel by heating at a temperature of not less than the $A_3$ point of the steel and not more than 1100° C. and bringing the steel into contact with a mixed gas atmosphere so as to concentrate nitrogen and carbon at a surface layer of the steel, the mixed gas atmosphere consisting of not less than 50 vol % of $NH_3$ and the balance of inert gas and inevitable impurities;

a step of quenching the steel to room temperature at a rate of not less than 20° C./second; and a step of tempering the steel at a temperature of 100 to 400° C.

2. The surface treatment method for the steel material according to claim 1, wherein in the step of carbonitriding, the heating temperature is 850 to 1000 ° C., and a heating time is 15 to 110 minutes.

3. The surface treatment method for the steel material according to claim 1, wherein in the step of carbonitriding, the concentration of $NH_3$ in the mixed gas atmosphere is 80 to 90 vol %.

4. A spring steel consisting of, by weight %, 0.27 to 0.48% of C, 0.01 to 2.2% of Si, 0.30 to 1.0% of Mn, not more than 0.035% of P, not more than 0.035% of S, and the balance of Fe, infiltrated N and inevitable impurities, the spring steel having a nitrogen compound layer and a carbon compound layer at a total thickness of not more than 2 μm at a surface thereof and having a center portion with hardness of 500 to 700 HV in a cross section, wherein the spring steel has a high hardness layer under the nitrogen compound layer and the carbon compound layer, and the high hardness layer has a thickness of 0.1 to 1.0 mm and has greater hardness than that of the center portion by 100 to 500 HV.

5. The spring steel according to claim 4, wherein the high hardness layer has a thickness of 0.3 to 1.0 mm.

6. The spring steel according to claim 4, wherein the spring steel has a carbonitrided layer under the nitrogen compound layer and the carbon compound layer, and the carbonitrided layer includes nitrogen and carbon at a total average concentration that is greater than a total concentration of nitrogen and carbon in the entire composition by 0.1 to 1.5 weight %.

7. The spring steel according to claim 6, wherein the carbonitrided layer has a thickness of 0.1 to 0.5 mm.

8. The spring steel according to claim 4, wherein the cross section has a circle-equivalent diameter of 1.5 to 15.0 mm.

9. A spring produced by using the spring steel recited in claim 4.

* * * * *